US008740559B2

(12) United States Patent
Wu et al.

(10) Patent No.: US 8,740,559 B2
(45) Date of Patent: Jun. 3, 2014

(54) FAN MODULE AND FAN RAIL THEREOF

(75) Inventors: Chun-An Wu, Taipei Hsien (TW); Chieh-Shih Yi, Taipei Hsien (TW)

(73) Assignee: Giga-Byte Technology Co., Ltd., New Taipei (TW)

( * ) Notice: Subject to any disclaimer, the term of this patent is extended or adjusted under 35 U.S.C. 154(b) by 774 days.

(21) Appl. No.: 12/844,840

(22) Filed: Jul. 28, 2010

(65) Prior Publication Data

US 2012/0027579 A1 Feb. 2, 2012

(51) Int. Cl.
*F04D 29/40* (2006.01)
*F04D 29/64* (2006.01)

(52) U.S. Cl.
USPC ..... 415/213.1; 361/679.48

(58) Field of Classification Search
USPC ..... 415/213.1, 214.1, 220, 223; 454/184, 454/248
See application file for complete search history.

(56) References Cited

U.S. PATENT DOCUMENTS

| | | | | |
|---|---|---|---|---|
| 6,592,327 | B2 * | 7/2003 | Chen et al. | 415/213.1 |
| 7,699,582 | B2 * | 4/2010 | Tao | 415/213.1 |
| 7,839,638 | B2 * | 11/2010 | Ye et al. | 361/695 |
| 7,907,404 | B2 * | 3/2011 | Wu et al. | 361/695 |
| 2011/0135461 | A1 * | 6/2011 | Li | 415/213.1 |

* cited by examiner

*Primary Examiner* — Nathaniel Wiehe
*Assistant Examiner* — Woody A Lee, Jr.
(74) *Attorney, Agent, or Firm* — Jianq Chyun IP Office

(57) ABSTRACT

A fan module and a fan rail thereof are provided. The fan module includes a fan, two fan rails, and a holder. The fan rails are disposed at both sides of the fan, in which each fan rail includes a main body and a ring, the main body has a first end and a sliding slot. The sliding slot is located at the first end. Each ring has a tab portion and a connecting portion, wherein the connecting portion has a protrusion buckled in the sliding slot. The fan is disposed in the holder by means of the fan rails, and a force is applied on the tab portion to make the protrusion slip in the sliding slot so that the ring suits to move back and forth on a longitudinal direction of the main body relatively to the main body so as to detach the fan from the holder.

16 Claims, 11 Drawing Sheets

FAN MODULE AND FAN RAIL THEREOF

BACKGROUND OF THE INVENTION

1. Field of the Invention

The invention generally relates to a fan module, and more particularly, to a fan module and a fan rail thereof.

2. Description of Related Art

The common handle design of a fan rail nowadays is unable to suit all fans. For a fan with high rotation speed, the fan has ribs for enhancing the structure stiffness, so that the fan handle is constrained to be used.

FIGS. 1A and 1B are diagrams of a fan and a fan rail in prior art. Referring to FIGS. 1A and 1B, two fan rails 120 are disposed at the two opposite sides of a fan 110 where no outlet/inlet is disposed at the sides. The top of the fan rail 120 has an L-shaped elastic arm 122. The end of the elastic arm 122 is hollowed out into a ring. Besides, the elastic arm 122 has further a retaining structure 124. When a fan assembled with the two fan rails 120 are disposed in a holder (not shown), the retaining structure 124 would interfere with the holder to be position-limited by each other and the fan 110 is thereby stably placed in the holder.

When a user wants to detach the fan 110 from the holder, the user uses the fingers going into the ring ends of the elastic arms 122 of the two fan rails 120, followed by applying two opposite forces to make the two elastic arms 122 close to each other. At the time, the position-limiting between the retaining structures 124 and the holder is released. Then, an upward force is applied to lift up the two fan rails 120, and the fan 110 is able to be drawn out from the holder.

The above-mentioned fan rails 120 can make the fan 110 conveniently detached from the holder. However, for different electronic apparatuses, the rotation speeds of the fan 110 are different. When a fan 110 has an extreme high rotation speed, the fan 110 requires ribs 112 for enhancing the structure stiffness. The disposing position of the ribs 112 is just corresponding to the ring ends of the elastic arms 122. As a result, the hands of the user would be blocked by the ribs and difficult to go into the ring ends, which affects detaching the fan 110.

SUMMARY OF THE INVENTION

Accordingly, the invention is directed to a novel fan rail.

The invention is also directed to a fan module able to be easily assembled and disassembled by using the above-mentioned novel fan rail.

The invention provides a fan rail, which includes a main body and a ring. The main body has a first end and a sliding slot, and the sliding slot is located at the first end. The ring has a tab portion and a connecting portion, in which the connecting portion has a protrusion, the protrusion is buckled in the sliding slot, and a force is applied on the tab portion to make the protrusion slip in the sliding slot so that the ring suits to move back and forth on a longitudinal direction of the main body relatively to the main body.

In an embodiment of the invention, the above-mentioned sliding slot is in '8' shape.

In an embodiment of the invention, the above-mentioned main body further has a second end, and both sides of the first end and the second end respectively have an elastic arm, in which each elastic arm has a short pillar, the positions of the short pillars are corresponding to each other and the short pillars outwards extend respectively in far away from each other. In addition, the main body further has a plurality of openings disposed at the first end and located between the elastic arms, and at least one of the openings is located under the elastic arm.

In an embodiment of the invention, the above-mentioned main body further has a guiding slot disposed correspondingly to the sliding slot, and the connecting portion of the ring is located in the guiding slot.

In an embodiment of the invention, each main body further has a position-limiting hook located over the sliding slot of the first end.

The invention further provides a fan module, which includes a fan, two fan rails and a holder. The fan rails are disposed at both sides of the fan, in which each fan rail includes a main body and a ring, the main body has a first end and a sliding slot. The sliding slot herein is located at the first end. The ring has a tab portion and a connecting portion, in which the connecting portion has a protrusion and the protrusion is buckled in the sliding slot. The fan is disposed in the holder by means of the fan rails, and a force is applied on the tab portion to make the protrusion slip in the sliding slot so that the ring suits to move back and forth on a longitudinal direction of the main body relatively to the main body.

In an embodiment of the invention, the above-mentioned sliding slot is in '8' shape.

In an embodiment of the invention, the above-mentioned main body further has a second end, and both sides of the first end and the second end respectively have an elastic arm, in which each elastic arm has a short pillar, the positions of the short pillars are corresponding to each other and the short pillars outwards extend respectively in far away from each other. The fan has a plurality of assembly openings and each short pillar is correspondingly knocked into one of the assembly openings. In addition, the main body further has a plurality of openings disposed at the first end and located between the elastic arms, and at least one of the openings is located under the sliding slot.

In an embodiment of the invention, the above-mentioned main body further has a guiding slot disposed correspondingly to the sliding slot, and the connecting portion of the ring is located in the guiding slot.

In an embodiment of the invention, each main body further has a position-limiting hook disposed on the first end and located over the sliding slot, the holder further has a plurality of knocking slots, and each position-limiting hook and one of the knocking slots are correspondingly position-limited by each other.

Based on the depiction above, the ring of the fan rail of the invention can move back and forth on the longitudinal direction of the main body relatively to the main body. Thus, when the fan is placed in the holder, the user can make the ring slip relatively to the main body so as to draw out, make the ring is higher than the main body and then lift the fan by applying a force and the user can conveniently draw out the fan from the holder.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
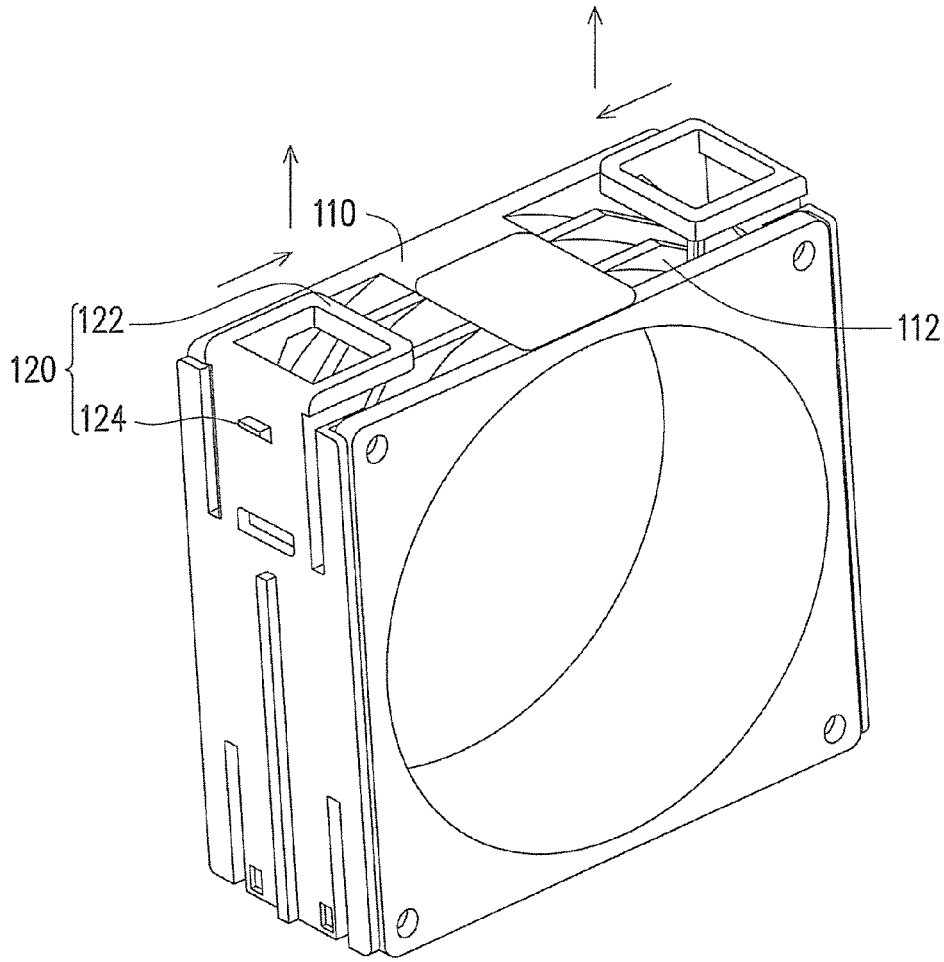
FIG. 1A (Prior Art)
FIGS. 1A and 1B are diagrams of a fan and fan rails thereof in prior art.
Figure 1B:
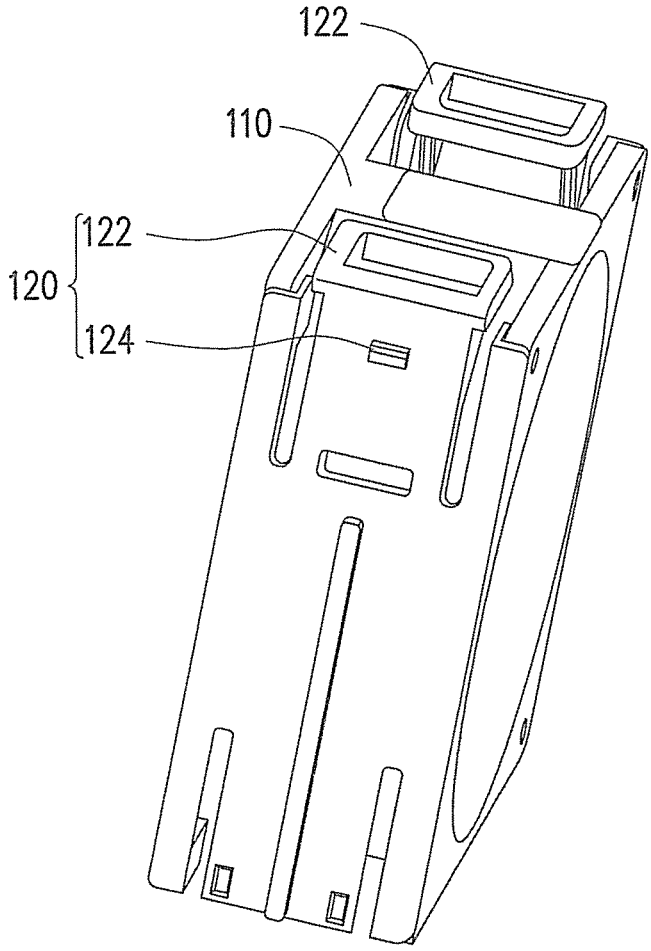
FIG. 1B (Prior Art)

Reference will now be made in detail to the preferred embodiments of the invention, examples of which are illustrated in the accompanying drawings. Wherever possible, the same reference numbers are used in the drawings and the description to refer to the same or like parts.

Figure 2A:
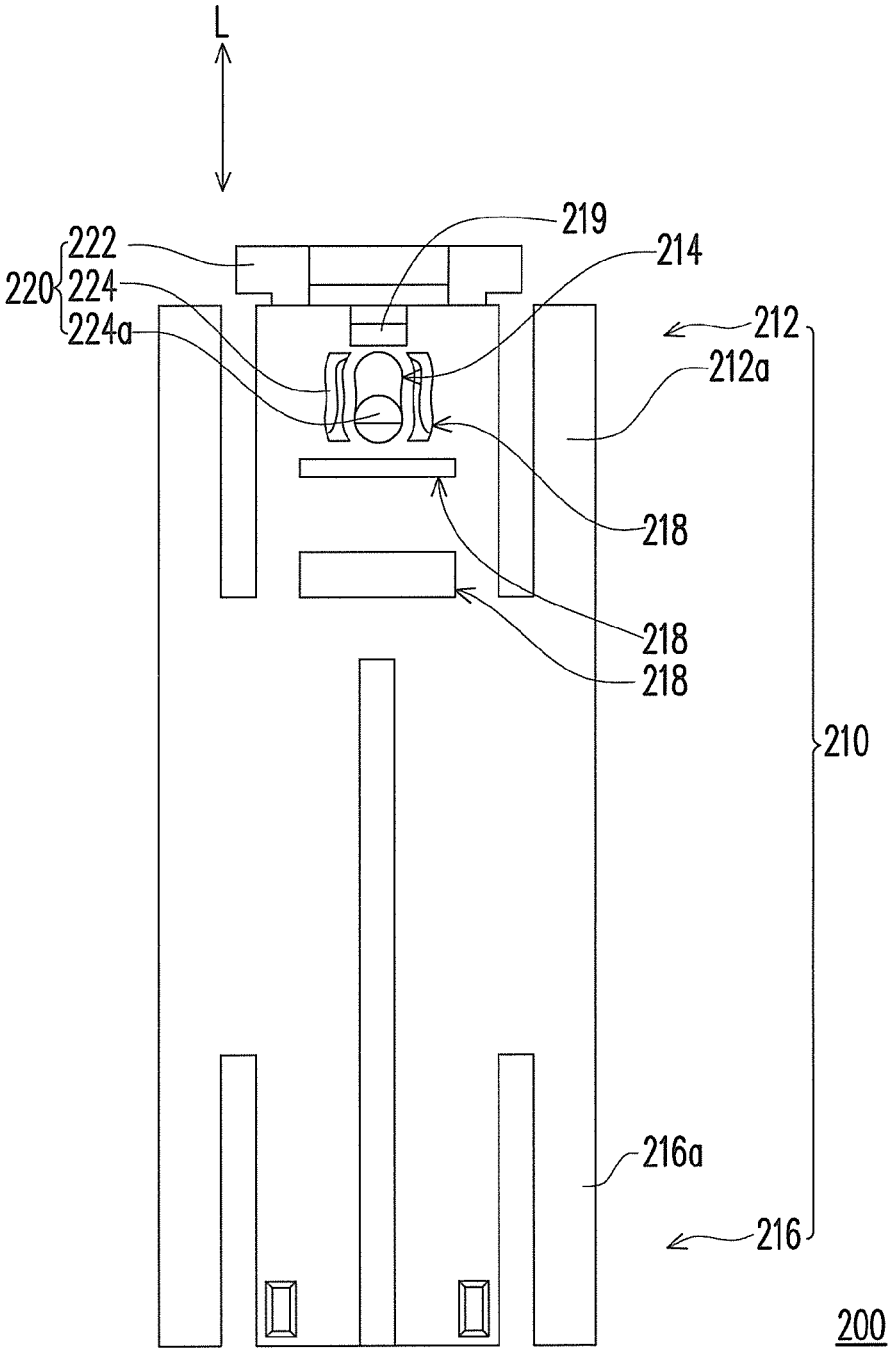
FIG. 2A is a diagram of a fan rail according to an embodiment of the invention.
Figure 2B:
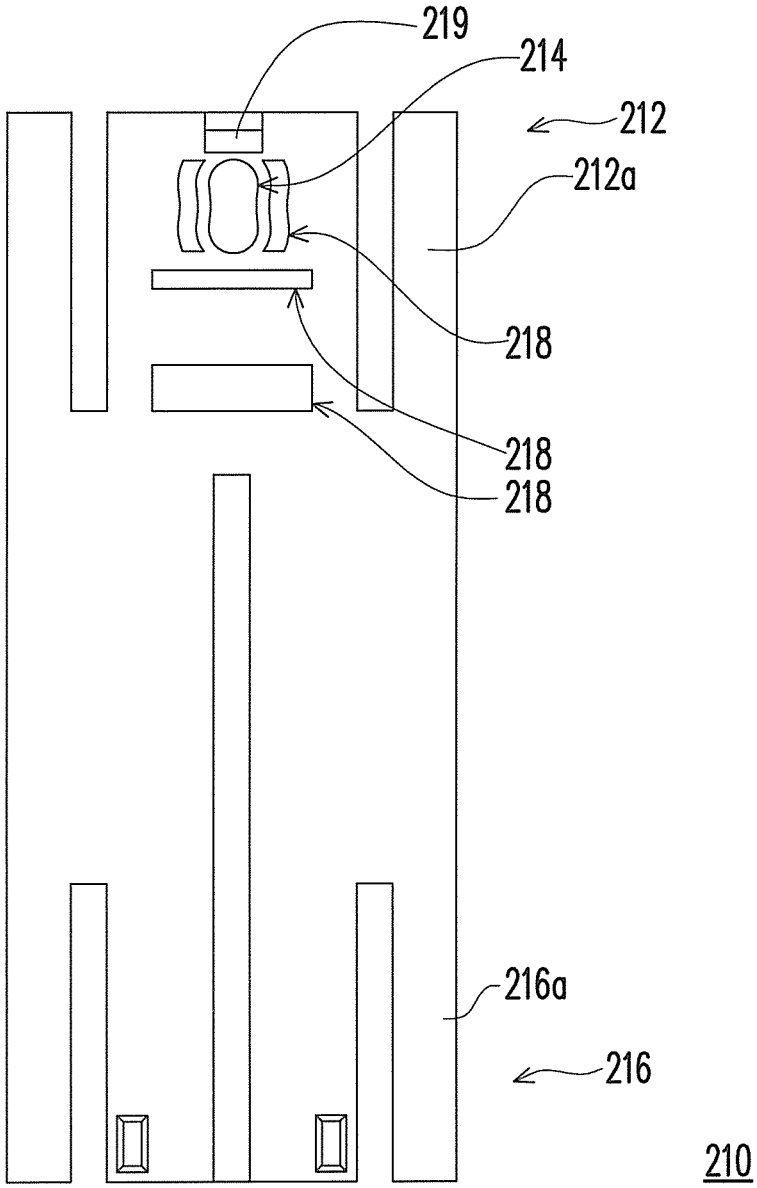
FIG. 2B is a diagram of the main body of FIG. 2A.
Figure 2C:
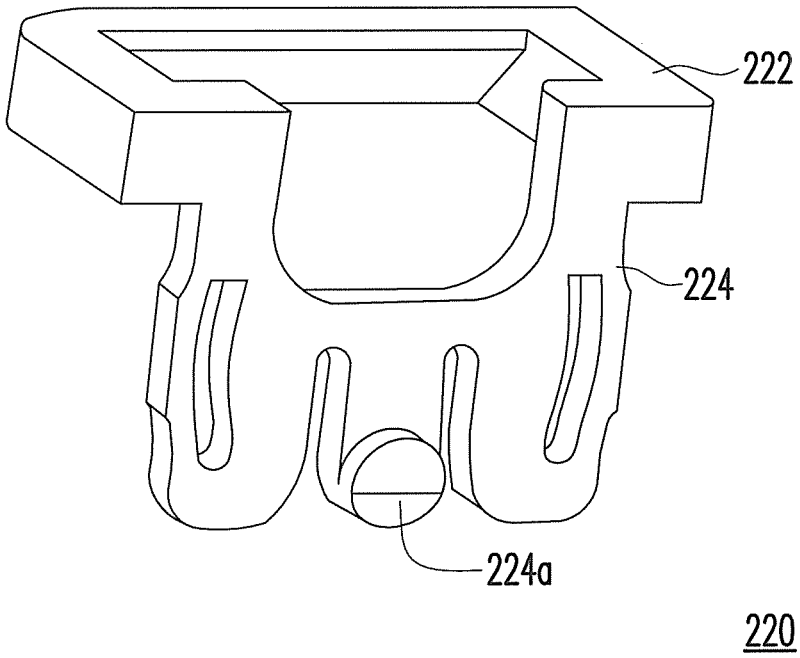
FIG. 2C is a diagram of the ring of FIG. 2B.

FIG. 2A is a diagram of a fan rail according to an embodiment of the invention, FIG. 2B is a diagram of the main body of FIG. 2A and FIG. 2C is a diagram of the ring of FIG. 2B. Referring to FIGS. 2A, 2B and 2C, a fan rail 200 includes a main body 210 and a ring 220. The main body 210 has a first end 212 and a sliding slot 214, and the sliding slot 214 is located at the first end 212. The ring 220 has a tab portion 222 and a connecting portion 224, in which the connecting portion 224 has a protrusion 224*a* and the protrusion 224*a* is buckled in the sliding slot 214. By buckling the protrusion 224*a* in the sliding slot 214, when a force is applied on the tab portion 222, the protrusion 224*a* can slip in the sliding slot 214 and the ring 220 can move back and forth on the longitudinal direction L of the main body 210 relatively to the main body 210.

Figure 2D:
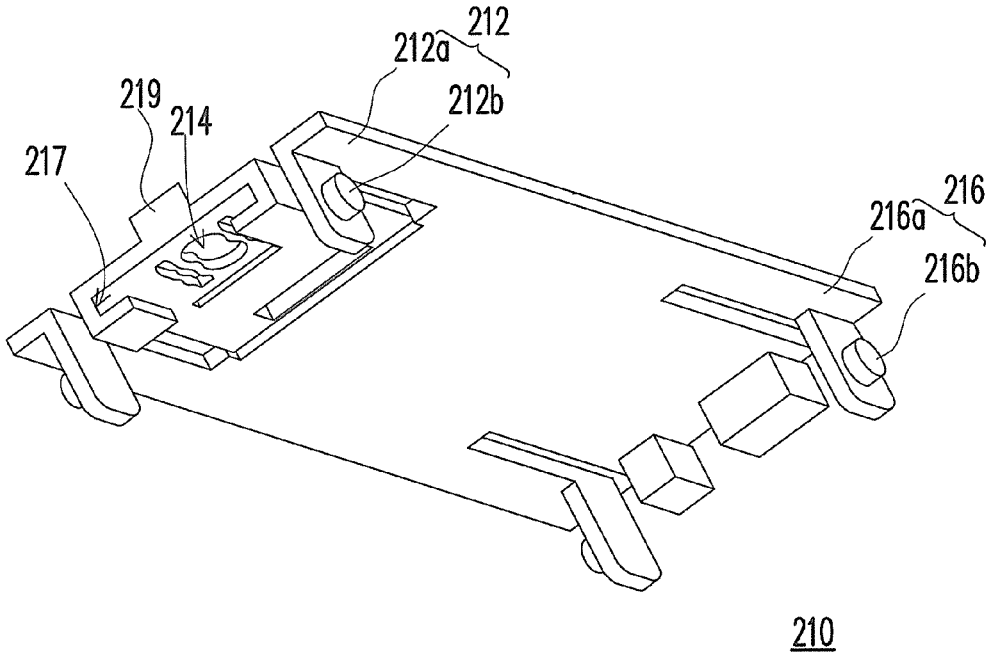
FIG. 2D is a diagram of the main body of FIG. 2B in another point of view.

FIG. 2D is a diagram of the main body of FIG. 2B in another point of view. Referring to FIGS. 2A, 2C and 2D, the sliding slot 214 is in '8' shape. The sliding slot 214 forms a step by means of the '8' shape so that the user applying a force to make the protrusion 224*a* slip in the sliding slot 214 enhances hand sensation and better controls the slip of the protrusion 224*a*.

The main body 210 further has a second end 216 and both sides of the first end 212 and the second end 216 respectively have an elastic arm 212*a* and an elastic arm 216*a*, in which each elastic arm 212*a* and each elastic arm 216*a* respectively have a short pillar 212*b* and a short pillar 216*b*. The positions of the two short pillars 212*b* or the two short pillars 216*b* are corresponding to each other and the two short pillars 212*b* or the two short pillars 216*b* outwards extend respectively in far away from each other. In addition, the main body 210 further has a plurality of openings 218 disposed at the first end 212, the openings 218 are located between the elastic arms 212*a* and at least one of the openings 218 is located under the sliding slot 214.

The main body 210 further has a guiding slot 217 with a position roughly corresponding to the sliding slot 214. The connecting portion 224 of the ring 220 is located in the guiding slot 217 so as to constrain the ring 220 after being assembled on the main body 210 preferably moving only on the longitudinal direction L of the main body 210 relatively to the main body 210.

Figure 3A:
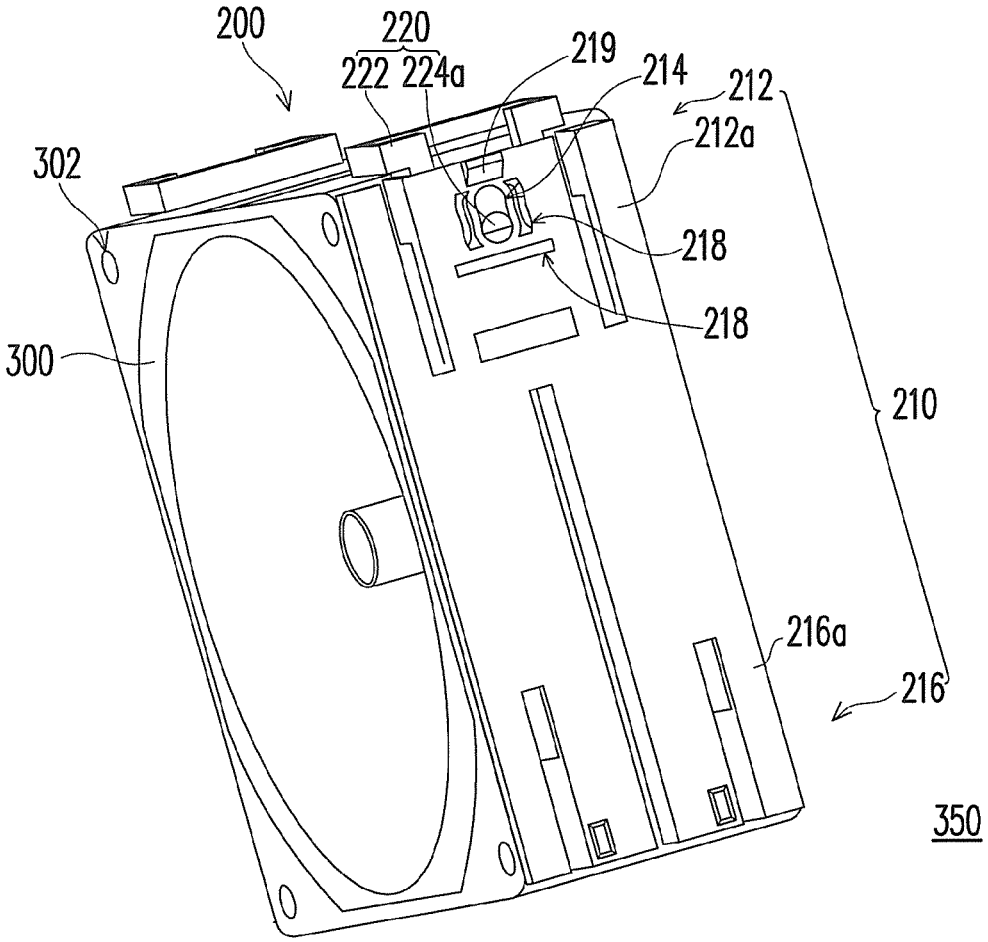
FIG. 3A is a diagram where a fan and two fan rails of FIG. 2A are assembled together.
Figure 3B:
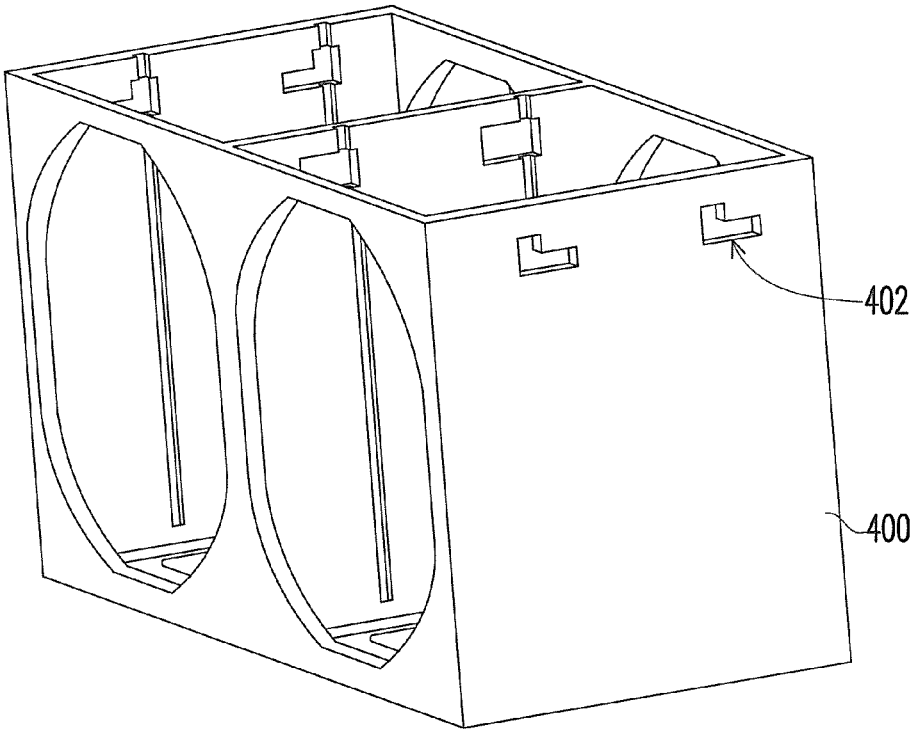
FIG. 3B is a diagram of a holder for accommodating the assembly of the fan and the fan rails in FIG. 2A.
Figure 4:
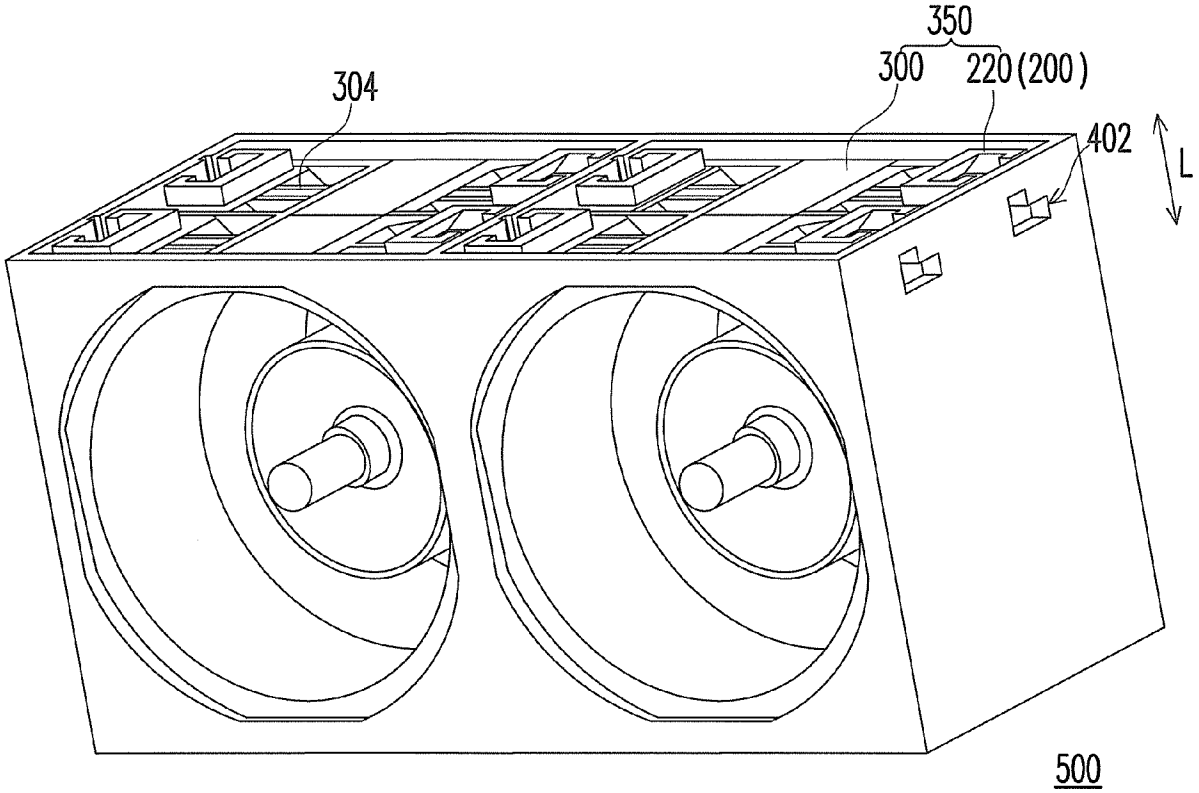
FIG. 4 is a diagram where a holder accommodates four assemblies of the fans and the fan rails.

FIG. 3A is a diagram where a fan and two fan rails of FIG. 2A are assembled together, FIG. 3B is a diagram of a holder for accommodating the assembly of the fan and the fan rails in FIG. 2A and FIG. 4 is a diagram where a holder accommodates four assemblies of the fans and the fan rails. In FIGS. 3B and 4, the blades of the fans are not shown for better understanding. Referring to FIGS. 3A, 3B and 4, the above-mentioned fan rails 200 are assembled at the opposite two sides of the fan 300 to form an assembly of fan and fan rail 350. After that, as shown by FIG. 4, the assembly of fan and fan rail 350 is placed in the holder 400 to finish assembling a fan module 500.

In more details, the fan 300 has a plurality of assembly openings 302. When the two fan rails 200 are assembled at the opposite two sides of the fan 300, the elastic arms 212*a* and the elastic arms 216*a* located at both sides of the first end 212 and the second end 216 of each fan rail 200 provide elastic forces to make the short pillars 212*b* of each elastic arm 212*a* and the short pillars 216*b* of each elastic arm 216*a* (as shown in FIG. 2D) respectively smoothly knocked into one of the assembly openings 302 so that the fan rails 200 can be fixed on the fan 300. In addition, the opening 218 located at the first end 212 of the main body 210 further enhances the structure elasticity of the first end 212, which, when the fan rails 200 are assembled on the fan 300 or detached from the fan 300, prevents excessive stress to cause damage.

Referring to FIGS. 2A, 3A and 4, each main body 210 further has a position-limiting hook 219. The position-limiting hook 219 is located on the first end 212 and over the sliding slot 214. The holder 400 has a plurality of knocking slots 402. When the assembly of fan and fan rail 350 is placed in the holder 400, each position-limiting hook 219 and one of the knocking slots 402 are correspondingly position-limited by each other.

Figure 5:
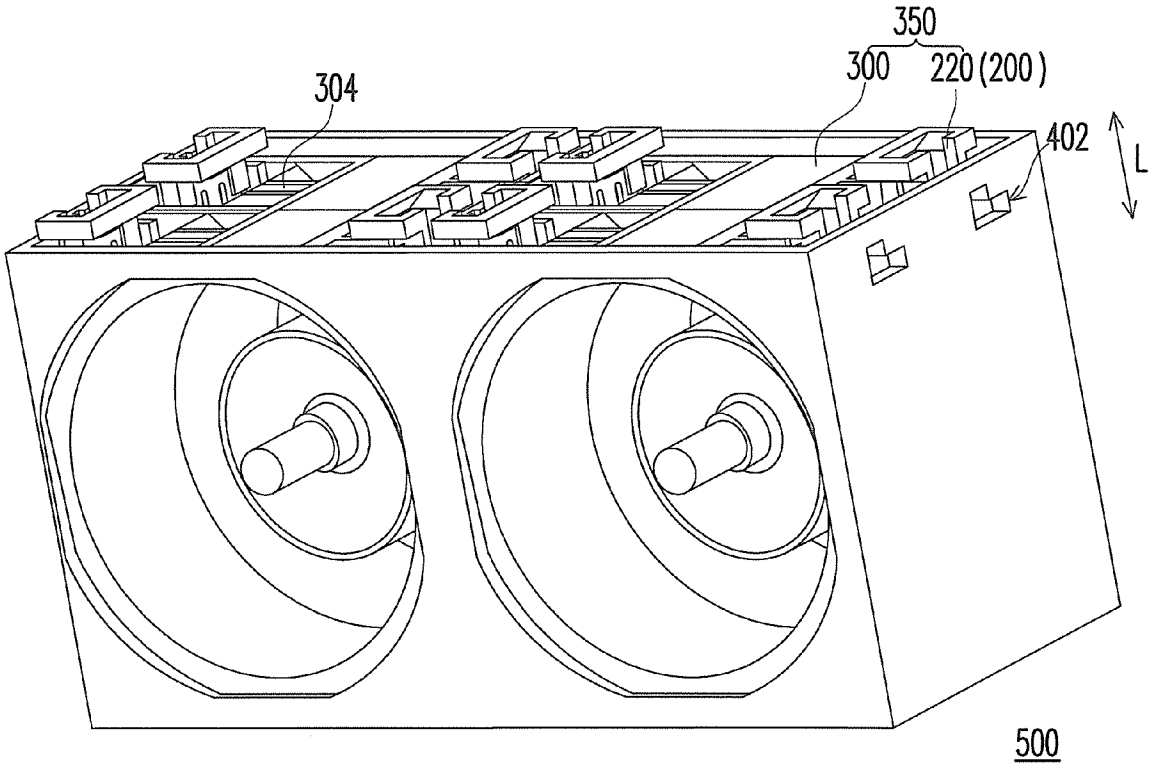
FIG. 5 is a diagram showing an assembly of fans and fan rails to be disassembled from a holder.
Figure 6:
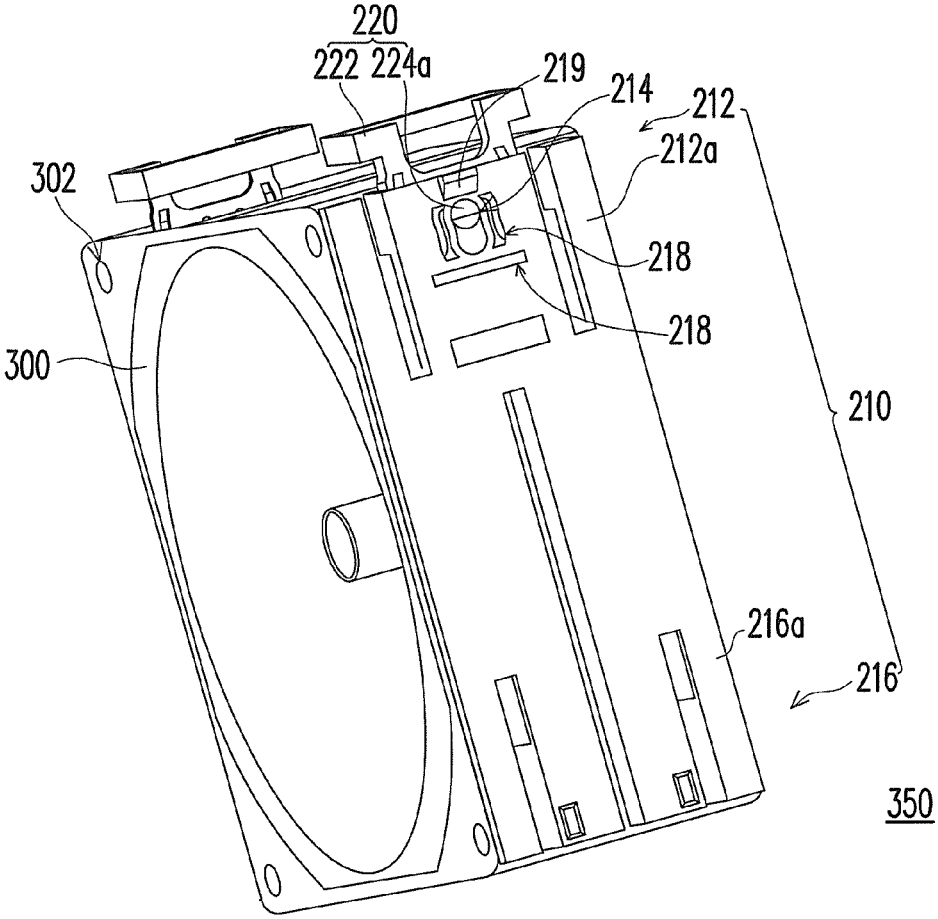
FIG. 6 is a diagram of the fan rails of FIG. 5.

FIG. 5 is a diagram showing an assembly of fans and fan rails to be disassembled from a holder and FIG. 6 is a diagram of the fan rails of FIG. 5. Referring to FIGS. 5 and 6, when the user wants to take out the assembly of fan and fan rail 350 from the holder 400, the user needs to apply a force to lift up the rings 220 of the two fan rails 200 on the longitudinal direction L, which makes the protrusion 224*a* located at the connecting portion 224 move to the upper hole of the sliding slot 214 from the lower hole of the sliding slot 214. At the time, the tab portion 222 of the ring 220 would be higher than the edge of the holder 400.

After that, the fingers of the user go through the tab portions 222 of the two rings 220 and then hook the two tab portions 222, so that the two tab portions 222 are closed to each other to release the position-limiting between the position-limiting hooks 219 of the main body 210 and the knocking slots 402. Further, the user applies a force on the longitude direction L to lift up the ring 200, so that the assembly of fan and fan rail 350 can be taken out from the holder 400.

In particular, when the user takes out the assembly of fan and fan rail 350 from the holder 400, the tab portion 222 of the ring 220 is higher than the edge of the holder 400. In this way, even the fan 300 in the fan module 500 has ribs for enhancing the structure stiffness 304, the fingers of the user still can go through the tab portions 222 and apply a force on the longitude direction L to lift up the ring 220. At the time, the assembly of fan and fan rail 350 can be conveniently taken out from the holder 400.

In summary, the fan rail of the invention includes a main body and a ring able to slip relatively to the main body. When the fan rail is assembled on a fan, the user can conveniently lift up the assembly of fan and fan rail and place the assembly of fan and fan rail into a holder. Since ring of the fan rail of the invention can slip on the longitude direction relatively to the main body, the fan rail can be used both in a fan with higher rotation speed and enhancing ribs and in a fan with lower rotation speed and without enhancing ribs. When the fan rail is assembled to a fan with higher rotation speed and enhancing ribs and the user wants to replace the fan in the fan module, the ring should be drawn out on the longitude direction of the main body relatively to the main body so that the ring is higher than the edge of the holder. In this way, the user can conveniently put the fingers into the tab portion to apply a force to lift up the fan, which eliminates the situation in the prior art that due to disposing the enhancing ribs the fingers of the user inconveniently go in the tab portion to apply force lifting up the tab portion. In other words, the fan rail and the fan module using the fan rail of the invention are advantageous in conveniently assembling and detaching the fan.

It will be apparent to those skilled in the art that the descriptions above are several preferred embodiments of the invention only, which does not limit the implementing range of the invention. Various modifications and variations can be made to the structure of the invention without departing from the scope or spirit of the invention.

What is claimed is:

1. A fan rail, comprising:

a main body, having a first end and a sliding slot, wherein the sliding slot is located at the first end and in an '8' shape with two openings; and a ring, having a tab portion and a connecting portion, wherein the connecting portion has a protrusion, the protrusion is buckled in one of the openings of the sliding slot, and a force is applied on the tab portion to make the protrusion slip toward another opening and being buckled therein of the sliding slot so that the ring suits to move back and forth on a longitudinal direction of the main body relatively to the main body.

2. The fan rail as claimed in claim 1, wherein the main body further has a second end, and both sides of the first end and the second end respectively have an elastic arm.

3. The fan rail as claimed in claim 2, wherein each elastic arm has a short pillar, the positions of the short pillars are corresponding to each other and the short pillars outwards extend respectively in far away from each other.

4. The fan rail as claimed in claim 2, wherein the main body further has a plurality of openings disposed at the first end and located between the elastic arms.

5. The fan rail as claimed in claim 4, wherein at least one of the openings is located under the sliding slot.

6. The fan rail as claimed in claim 1, wherein the main body further has a guiding slot disposed correspondingly to the sliding slot, and the connecting portion of the ring is located in the guiding slot.

7. The fan rail as claimed in claim 1, wherein each main body further has a position-limiting hook disposed on the first end and located over the sliding slot.

8. A fan module, comprising:

a fan;

two fan rails, disposed at both sides of the fan, wherein each fan rail comprises:

a main body, having a first end and a sliding slot, wherein the sliding slot is located at the first end and in an '8' shape with two openings; and a ring, having a tab portion and a connecting portion, wherein the connecting portion has a protrusion and the protrusion is buckled in one of the openings of the sliding slot; and a holder, wherein the fan is disposed in the holder by means of the fan rails, and a force is applied on the tab portion to make the protrusion slip toward another opening and being buckled therein of the sliding slot so that the ring suits to move back and forth on a longitudinal direction of the main body relatively to the main body.

9. The fan module as claimed in claim 8, wherein the main body further has a second end, and both sides of the first end and the second end respectively have an elastic arm.

10. The fan module as claimed in claim 9, wherein each elastic arm has a short pillar, the positions of the short pillars are corresponding to each other and the short pillars outwards extend respectively in far away from each other, the fan has a plurality of assembly openings and each short pillar is correspondingly knocked into one of the assembly openings.

11. The fan module as claimed in claim 9, wherein the main body further has a plurality of openings disposed at the first end and located between the elastic arms.

12. The fan module as claimed in claim 11, wherein at least one of the openings is located under the sliding slot.

13. The fan module as claimed in claim 8, wherein the main body further has a guiding slot disposed correspondingly to the sliding slot, and the connecting portion of the ring is located in the guiding slot.

14. The fan module as claimed in claim 8, wherein each main body further has a position-limiting hook disposed on the first end and located over the sliding slot, the holder further has a plurality of knocking slots, and each position-limiting hook and one of the knocking slots are correspondingly position-limited by each other.

15. A fan module, comprising:

a fan, having a rib;

two fan rails, disposed at both sides of the fan, wherein each fan rail comprises:

a main body, having a first end and a sliding slot, wherein the sliding slot is located at the first end; and a ring, having a tab portion and a connecting portion, wherein the connecting portion has a protrusion and the protrusion is buckled in the sliding slot; and a holder, wherein the fan is disposed in the holder by means of the fan rails, and a force is applied on the tab portion to make the protrusion slip in the sliding slot so that the ring suits to move back and forth on a longitudinal direction of the main body relatively to the main body to be close to the rib of the fan and away from the rib of the fan, wherein when the ring is away from the rib of the fan, fingers of a user go through the tab portions without being interfered with the rib and lift up the fan and the fan rails out of the holder in the longitudinal direction.

16. The fan module as claimed in claim 15, wherein the tab portion of the ring is higher than an edge of the holder when the ring is away from the rib of the fan.

* * * * *